US009726428B2

(12) United States Patent
Simmon et al.

(10) Patent No.: US 9,726,428 B2
(45) Date of Patent: Aug. 8, 2017

(54) FRAMED DRYING RACK

(71) Applicant: Honey-Can-Do International, LLC, Berkeley, IL (US)

(72) Inventors: Alexandra M. Simmon, Inverness, IL (US); Steven B. Greenspon, Berkeley, IL (US)

(73) Assignee: Honey-Can-Do International, LLC, Berkeley, IL (US)

( * ) Notice: Subject to any disclaimer, the term of this patent is extended or adjusted under 35 U.S.C. 154(b) by 152 days.

(21) Appl. No.: 14/134,215

(22) Filed: Dec. 19, 2013

(65) Prior Publication Data

US 2015/0176898 A1 Jun. 25, 2015

(51) Int. Cl.

| | |
|---|---|
| ***F26B 25/18*** | (2006.01) |
| ***D06F 57/12*** | (2006.01) |
| ***F26B 9/10*** | (2006.01) |
| ***F26B 9/00*** | (2006.01) |

(52) U.S. Cl.

CPC ..... *F26B 25/18* (2013.01); *D06F 57/12* (2013.01); *F26B 9/003* (2013.01); *F26B 9/006* (2013.01); *F26B 9/10* (2013.01)

(58) Field of Classification Search

CPC ..... F26B 25/18

USPC ..... 108/5

See application file for complete search history.

(56) References Cited

U.S. PATENT DOCUMENTS

| | | | | | |
|---|---|---|---|---|---|
| 1,858,103 | A * | 5/1932 | Menon | A47B 39/02 | 108/5 |
| 1,920,452 | A * | 8/1933 | Wagner | A47B 41/02 | 108/32 |
| 2,542,820 | A * | 2/1951 | Legois | A47C 1/16 | 297/351 |
| 2,973,869 | A * | 3/1961 | Raymond | B61D 37/003 | 108/152 |
| 3,096,957 | A * | 7/1963 | Peterson | A01K 39/022 | 242/129.1 |
| 3,132,835 | A * | 5/1964 | Drabert | A47C 16/025 | 108/5 |
| 4,145,097 | A * | 3/1979 | Naess | A47B 21/03 | 108/28 |

(Continued)

OTHER PUBLICATIONS

Harriet Schechter, "Lighten the load", Aug. 26, 2007, WriteInTime.*

(Continued)

*Primary Examiner* — Kenneth Rinehart
*Assistant Examiner* — Logan Jones
(74) *Attorney, Agent, or Firm* — Adam K. Sacharoff; Much Shelist, P.C.

(57) ABSTRACT

A drying rack assembly having a frame that defines a window. A drying support structure with drying rods is provided and mounted in the window by pivot brackets. At least one strap is secured between the frame and drying support structure. The interior sides of the frame include slots that define a top resting position and a bottom resting position with a slidable pole being positioned in the slots. The pole extends across the window with the strap extending behind the pole such that when the pole is moved into the top or bottom resting position, the strap configures the drying rack structure into a full extension position or a partial extension position away from the frame support structure.

8 Claims, 3 Drawing Sheets

(56) References Cited

U.S. PATENT DOCUMENTS 4,280,593 A * 7/1981 Moore ..... B66B 9/06 182/10
4,325,193 A * 4/1982 Thompson ..... A01N 1/02 34/92
4,460,145 A * 7/1984 Ando ..... A47B 46/00 108/140
4,736,689 A * 4/1988 Stanko ..... A47B 21/0314 108/143
4,807,766 A * 2/1989 Compagnucci ..... D06F 57/08 211/198
4,856,206 A * 8/1989 Klein ..... D06F 57/12 219/386
5,168,642 A * 12/1992 Hansen ..... A01F 25/12 211/113
5,394,619 A * 3/1995 Kaplan ..... D06F 57/127 34/104
5,707,034 A * 1/1998 Cotterill ..... A47B 21/0314 108/5
5,725,111 A * 3/1998 Choi ..... A47B 21/0314 108/5
6,073,783 A * 6/2000 Allman ..... F26B 25/18 211/85.3
6,164,218 A * 12/2000 Donalson ..... A47B 23/007 108/144.11
6,464,091 B1 * 10/2002 Nagasaki ..... A47G 25/0685 211/1.3
6,581,891 B1 * 6/2003 Byrd ..... A01K 31/14 248/218.4
7,175,146 B2 * 2/2007 Kim ..... F16M 11/10 211/100
7,832,780 B1 * 11/2010 Ramseyer ..... B60P 3/36 108/44
8,375,525 B1 * 2/2013 Huang ..... B60P 7/0846 24/68 CD
8,840,201 B2 * 9/2014 Garnett ..... A47L 15/504 312/228.1
8,844,737 B2 * 9/2014 Bukowski ..... D06F 57/12 211/100
2002/0033436 A1 * 3/2002 Peng ..... F16M 11/10 248/284.1
2005/0076530 A1 * 4/2005 Kresser ..... F26B 25/18 34/91
2011/0121601 A1 * 5/2011 Zielinsky ..... B62D 33/0273 296/57.1
2014/0016881 A1 * 1/2014 Loudenslager ..... A45C 13/26 383/13
2014/0028046 A1 * 1/2014 Cauley ..... B62D 33/0273 296/57.1

OTHER PUBLICATIONS

Gail, "Ballard design inspired drying rack", Jun. 24, 2013, MyRepurposedLife.*
Ballard Designs, Beadboard Drying Rack, 2013 Website, www.ballarddesigns.com/beadbaord-drying-rack/286725.

* cited by examiner

FRAMED DRYING RACK

FIELD OF THE INVENTION

The present invention relates to a drying rack and, more particularly, to an adjustable drying rack mounted within a frame for hanging on a wall or surface.

DISCUSSION OF THE RELATED ART

Drying racks are well known and used extensively for drying laundry and other type of Items. In addition, there are in the prior art drying racks that are mounted within a frame for hanging on a wall or surface. The drying rack is secured to the frame by straps allowing the drying rack to extend out to a first extension position from the frame and can be positioned vertically within the frame for storage. One major problem with this prior art drying rack is that the rack only extends to a single position from the frame. In many circumstances and households, having multiple positions for the rack is important for drying purposes, space concerns in the household, and convenience. As such the main aspect of the present invention is to provide a solution to these disadvantages in the prior art.

SUMMARY OF THE INVENTION

The present invention is directed to a drying rack assembly. The assembly includes a frame support structure defined by top and bottom frame supports, a pair of side frame supports positioned between the top and bottom frame supports and along ends of the top and bottom frame supports to define a window therebetween. A drying support structure is provided and mounted in the window, the drying support structure is defined by having top and bottom rack supports, a pair of side rack supports positioned between the top and bottom rack supports and along ends of the top and bottom rack supports, and further having a plurality of rods positioned and secured between the side rack supports. At least one strap is secured at one end to a top portion of the drying support structure and is further secured at another end to a top portion of the frame support structure. Positioned along each of the side frame supports is a slot that includes at least a top resting position and a bottom resting position. In addition, a pole is provided with ends separately positioned within the slots and wherein the strap extends behind the pole such that when the pole is moved into either the top resting position or the bottom resting position, the at least one strap configures the drying support structure into a full extension position or a partial extension position from the frame support structure.

In other aspects of the invention, the frame support structure further includes a back support secured about one side of the top, bottom, and side supports. In this instance, each strap is secured at one end to a top portion of the back support of the frame support structure.

In yet other aspects of the invention, the drying support structure is pivotally mounted within the window by brackets positioned between the bottom support and bottom rack support. And in yet other aspects of the invention, each slot has an elongated portion extending along a portion of the side frame support, the elongated portion having a bottom and a top, and the bottom resting position is defined along the bottom as having a bottom perpendicular portion and then a bottom downward portion, and the top resting position is defined along the top as having a top perpendicular portion and then a top downward portion.

BRIEF DESCRIPTION OF THE DRAWINGS

For a fuller understanding of the nature of the present invention, reference should be made to the following detailed description taken in conjunction with the accompanying drawings in which.

DETAILED DESCRIPTION OF THE PREFERRED EMBODIMENTS

Referring to the several views of the drawings, the framed drying rack of the present invention is shown and is generally indicated as 10.

Figure 1:
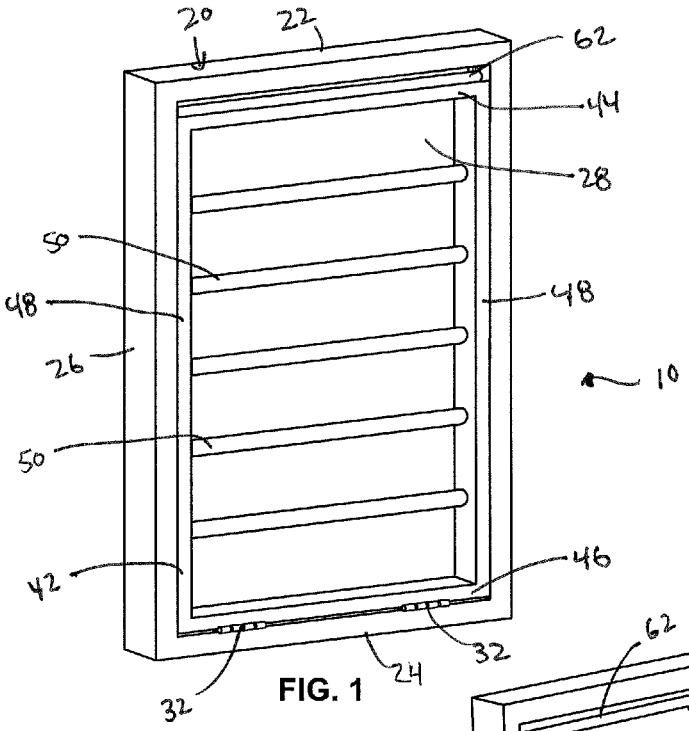
FIG. 1 is a perspective view of the framed drying rack in accordance with one embodiment of the present invention.
Figure 6:
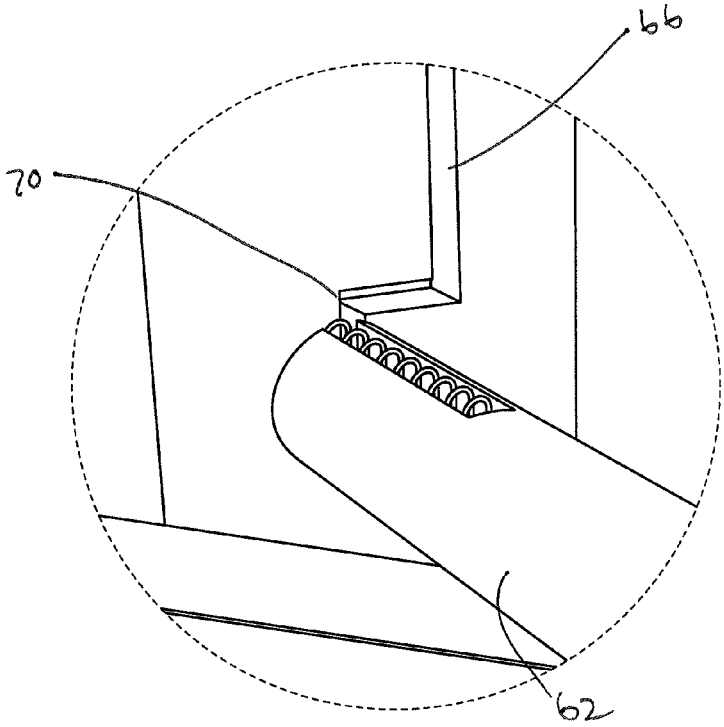
FIG. 6 is a partial enlarged view showing the slot and a spring loaded pin end defined on the pole in accordance with one embodiment of the present invention.

With initial reference to FIGS. 1 and 6, the framed drying rack 10 has a supporting frame structure 20, which includes top and bottom supports, 22 and 24 respectively, with side supports 26 therebetween to space the top and bottom supports apart. A back support 28 may be secured to the frame structure 20 for support.

The drying rack 40 is mounted within a window 30 defined by the supporting frame structure 20. The drying rack 40 similarly includes a rack support structure 42 defined by having top and bottom rack supports, 44 and 46 respectively, and further having side rack supports 48. A plurality of rods 50 are positioned and secured between the side rack supports 48. The rods 50 provide a means for holding or hanging items thereon for drying.

The drying rack 40 is pivotally mounted within the window to the supporting frame structure 20 by one or more pivot brackets 32. This permits the drying rack 40 from pivoting into and away from the window 30. A pair of straps 34 is secured at one end to a top portion of the drying rack 40, which could include securing the end 36 of the straps to the top rack support 44. The other end 38 of the straps 34 is secured to a top portion of the supporting frame structure 20, which may include securing the end 38 of the straps to the top support 22 or an upper section of the back support 29. As such, when the drying rack 40 is pivoted away from the supporting frame structure 20 the straps extend and the length of the straps determines the distance the drying rack will extend.

Figure 2:
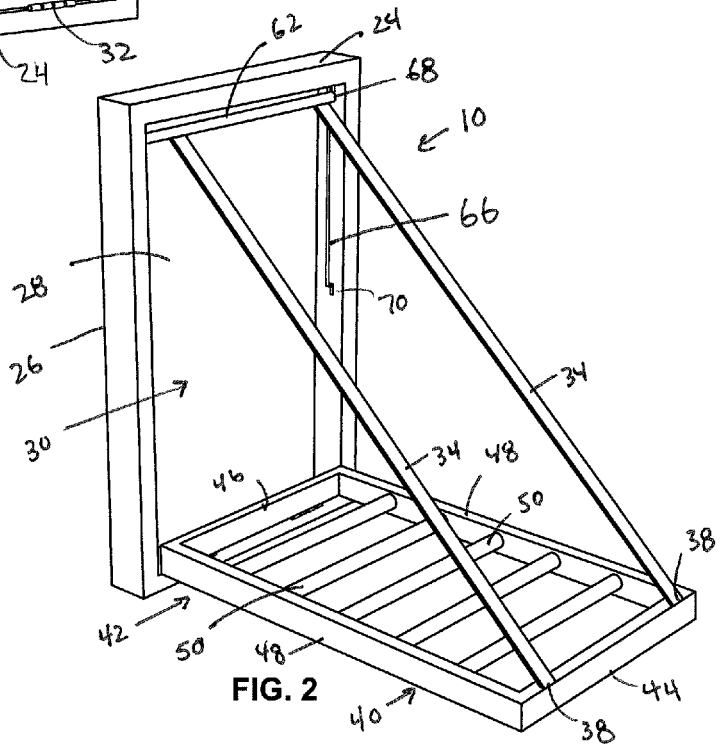
FIG. 2 is a perspective view of the framed drying rack in accordance with one embodiment of the present invention and illustrating the drying rack in a fully extended position.
Figure 3:
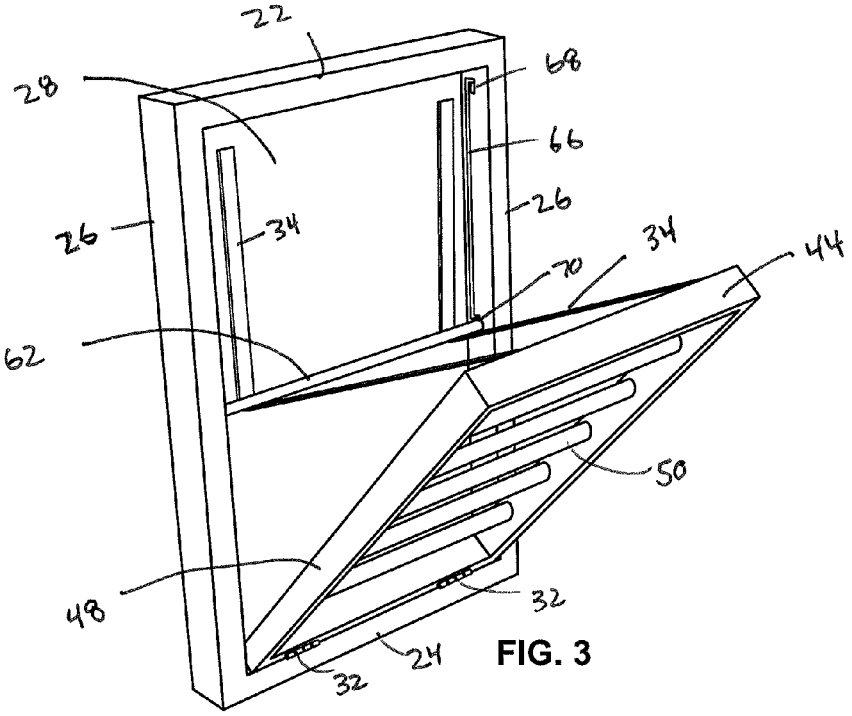
FIG. 3 is a perspective view of the framed drying rack in accordance with one embodiment of the present invention and illustrating the drying rack in a partially extended position.
Figure 4:
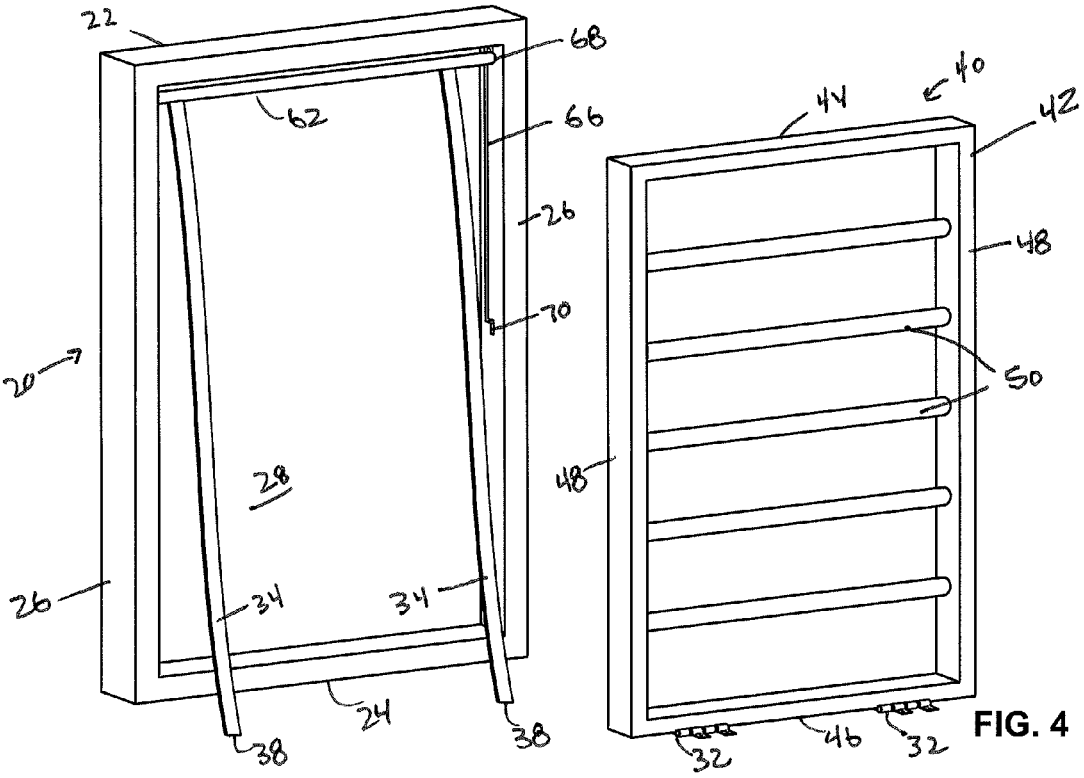
FIG. 4 is a partial exploded view of the frame support structure and the drying rack support in accordance with one embodiment of the present invention.
Figure 5:
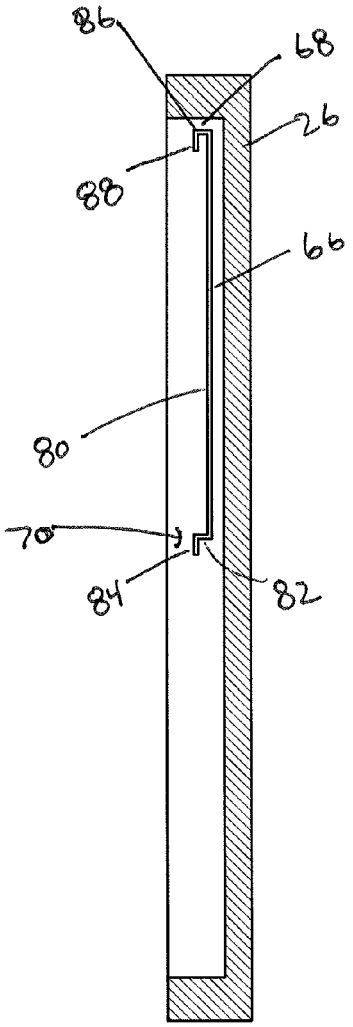
FIG. 5 is a side view of an interior portion of the frame support structure showing the slot defined thereon.

The improvement in the current invention is defined by further providing a means to adjust 60 the straps 34 to different lengths and thereby allowing drying rack to extend to two or more extension positions. The adjusting means is defined by having the straps extend behind a pole 62 that is secured at its ends to the side supports 26. The ends 64 of the pole 62 rest in slots 66 defined on each of the side supports 26. The slots 66 include a top resting position 68 and a bottom resting position 70 that the pole 62 can slide into and rest. Other positioned can be included if desired. When the pole 62 is positioned at the top resting position the straps can be fully extended and the drying rack can be positioned in a fully extending position (FIG. 2). When the pole 62 is positioned at the bottom resting position, a portion of the straps are held adjacently against the back support 28 of the frame structure 20 and then the rest of the straps extend away from the pole allowing the drying rack to be positioned in a partially extending position (FIG. 3).

In one embodiment of the invention, each slots 66 has an elongated portion 80 extending along a portion of the side support 26. At the bottom of the elongated portion 80, the slot then travels to a bottom perpendicular portion 82 and then travels into a bottom downward portion 84. The bottom perpendicular portion 82 and the bottom downward portion 84 help to define the bottom resting position (as shown in FIG. 3). At the top of the elongated portion 80, the slot travels to a top perpendicular portion 86 and then into a top downward portion 88. The top perpendicular portion 86 and the top downward portion 88 help to define the top resting position (as shown in FIG. 2).

Lastly, the pole 62 may include ends with a spring engaging pin to help position and glide the ends of the pole 62 in the slots.

When assembled the drying rack can be easily hung or secured to a wall of surface.

While the instant invention has been shown and described in accordance with a preferred and practical embodiment thereof, it is recognized that departures from the instant disclosure are contemplated within the spirit and scope of the present invention.

What is claimed is:

1. A drying rack assembly comprising:

a frame support structure defined by top and bottom frame supports, and a pair of side frame supports positioned between the top and bottom frame supports along ends of the top and bottom frame supports to define a window therebetween, a drying support structure defined by having top and bottom rack supports, and a pair of side rack supports positioned between the top and bottom rack supports along ends of the top and bottom rack supports, and further having a plurality of rods positioned and secured between the side rack supports, and wherein the drying support structure is pivotally mounted within the window;

at least one strap, each strap is secured at one end to a top portion of the drying support structure and is further secured at another end to a top portion of the frame support structure;

a slot positioned vertically along each of the side frame supports, each slot includes at least a top resting position and a bottom resting position, and wherein the top resting position is further defined as extending horizontally from a top terminal end of the slot and then extending vertically towards the bottom frame support to configure the top resting position that has a U-shaped profile, and wherein the bottom resting position is further defined as extending horizontally from a bottom terminal end of the slot and then extending vertically towards the bottom frame support to configure the bottom resting position that has an L-shaped profile; and a pole having ends separately positioned within the slots and wherein the at least one strap extends behind the pole such that when the pole is moved into either the top U-shaped profile such that the pole is in the top resting position or the bottom L-shaped profile such that the pole is in the bottom resting position, the pole is secured in position and the at least one strap configures the drying support structure into a full extension position or a partial extension position from the frame support structure.

2. The drying rack assembly of claim 1, wherein the frame support structure further includes a back support secured about one side of the top, bottom, and side supports.

3. The drying rack assembly of claim 1, wherein the drying support structure is pivotally mounted within the window by brackets positioned between the bottom support and bottom rack support.

4. The drying rack assembly of claim 2, wherein each strap is secured at one end to a top portion of the back support of the frame support structure.

5. A drying rack assembly comprising:

a frame with a window defined therein;

a drying support structure with drying rods is provided and mounted in the window by brackets along a bottom portion thereof to permit a top portion of the drying rack to pivot away from the window;

at least one strap is secured between the frame and drying support structure;

slots defined vertically along interior sides of the frame, each slot further having a top resting position and a bottom resting position, and wherein the top resting position is further defined as extending horizontally from a top terminal end of the slot and then extending vertically towards the bottom frame support to configure the top resting position that has a U-shaped profile, and wherein the bottom resting position is further defined as extending horizontally from a bottom terminal end of the slot and then extending vertically towards the bottom frame support to configure the bottom resting position that has an L-shaped profile; and a pole slidably positioned in the slots, the pole extends across the window with the at least one strap extending behind the pole such that when the pole is moved into the top U-shaped profile such that the pole is in the top resting position or the bottom L-shaped profile such that the pole is in the bottom resting position, the strap configures the drying rack structure into a full extension position or a partial extension position away from the frame support structure.

6. The drying rack assembly of claim 5, wherein the frame support structure further includes a back support secured about one side of the top, bottom, and side supports.

7. The drying rack assembly of claim 5, wherein the drying support structure is pivotally mounted within the window by brackets positioned between the bottom support and bottom rack support.

8. The drying rack assembly of claim 6, wherein each strap is secured at one end to a top portion of the back support of the frame support structure.

* * * * *